US008056757B2

(12) United States Patent
Mansour et al.

(10) Patent No.: US 8,056,757 B2
(45) Date of Patent: Nov. 15, 2011

(54) HOT BEVERAGE CUP SLEEVE

(75) Inventors: Rached Ben Mansour, Dhahran (SA); Muhammad A. Hawwa, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 567 days.

(21) Appl. No.: 12/222,163

(22) Filed: Aug. 4, 2008

(65) Prior Publication Data

US 2010/0025414 A1 Feb. 4, 2010

(51) Int. Cl.
*B65D 25/00* (2006.01)

(52) U.S. Cl. ..... 220/739; 220/737

(58) Field of Classification Search ..... 220/738, 220/739, 592.17, 737, 740, 741, 742, 743; 229/403; 493/907

See application file for complete search history.

(56) References Cited

U.S. PATENT DOCUMENTS 5,205,473 A 4/1993 Coffin, Sr.
5,660,326 A * 8/1997 Varano et al. ..... 229/403
5,697,550 A 12/1997 Varano et al.
5,713,512 A * 2/1998 Barrett ..... 229/403
6,814,253 B2 11/2004 Wong
6,926,197 B2 * 8/2005 Hed et al. ..... 229/403
6,986,438 B2 1/2006 Leung

FOREIGN PATENT DOCUMENTS

JP 02005104578 A * 4/2005

OTHER PUBLICATIONS

JP 02005104578 A abstract translation.*

* cited by examiner

*Primary Examiner* — Anthony Stashick
*Assistant Examiner* — Jeffrey Allen
(74) *Attorney, Agent, or Firm* — Richard C. Litman

(57) ABSTRACT

A hot beverage cup and sleeve bring together two modes of heat transfer, conduction and radiation. The sleeve has an inner face with a plurality of high reflectivity surfaces for radiating heat back to the cup. The sleeve also has a plurality of insulating members for containing insulating air. Each of the insulating members is positioned to space the high reflectivity surfaces away from the cup. A low emissivity film can be adhered to the cup without touching the insulating members. The film can also be attached to the sleeve facing but spaced from the high reflectivity surfaces. This cup and sleeve arrangements minimize thermal contact and reduce heat transfer. Thus, the hot beverage cup and sleeve protect a person's hand as well as extend the time of keeping the beverage hot.

18 Claims, 6 Drawing Sheets

HOT BEVERAGE CUP SLEEVE

BACKGROUND OF THE INVENTION

1. Field of the Invention

The present invention relates to food containers, and particularly to a hot beverage cup sleeve that allows a person to hold the cup without burning one's fingers while retaining heat in the cup for preventing the beverage from cooling too quickly.

2. Description of the Related Art

Coffee shop franchises nowadays serve hot beverages in disposable cups made from inexpensive and biodegradable materials. In order to make these cups safe for a person or customer to handle, different types of cup sleeves have been utilized. Many such sleeves are also made of recyclable materials. Of course, the ideal cup and sleeve would protect the person's hand from excessive heat while keeping the beverage hot for an extended period of time.

To protect the person's hand, the current hot beverage sleeves available on the market utilize the science of heat transfer. One type of hot beverage sleeve uses a double-layering practice for the sleeve to increase the level of thermal insulation. The other type of hot beverage sleeve uses corrugated paperboard or cardboard material to create air spaces around the cup to provide a certain degree of insulation of the heat.

From a heat transfer point of view, these insulation sleeves are based on physical laws of heat conduction, only. As is commonly known, heat can be transferred by conduction, convection, or radiation. Currently, the available hot beverage sleeves utilize heat conduction by isolating the heat. The heat is then directed either up or down the sleeve, with the sleeve heating up and the beverage cooling down, thus, making the sleeve hot to touch or the hot beverage cold to drink.

Thus, a hot beverage cup sleeve solving the aforementioned problems is desired.

SUMMARY OF THE INVENTION

The hot beverage cup sleeve is an insulating sleeve placed around a hot beverage cup to prevent loss of heat through the cup wall. The sleeve has a tubular wall. A plurality of spaced apart insulating strips or pads are disposed on the inner surface of the tubular wall, and a plurality of thermal reflective surfaces are disposed on the inner surface of the wall in the gaps between the insulating strips. A low (heat) emissivity film is attached to the outer surface of the cup wall in the gaps between the insulating strips. Alternatively, the sleeve may have both an inner wall and an outer wall, with the low emissivity film being disposed on the outer surface of the inner wall between the insulating strips.

This disposition of insulating components reduces heat loss from the walls of the cup by conductance through the high insulation value of the insulating strips and the air gap between the outer sleeve wall and the cup; by convection through the insulation provided by the air gaps; and by radiation through the combination of the low emissivity film and the reflective surfaces.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The hot beverage cup sleeve protects a person's hand and keeps a beverage in the cup warm.

Figure 1:
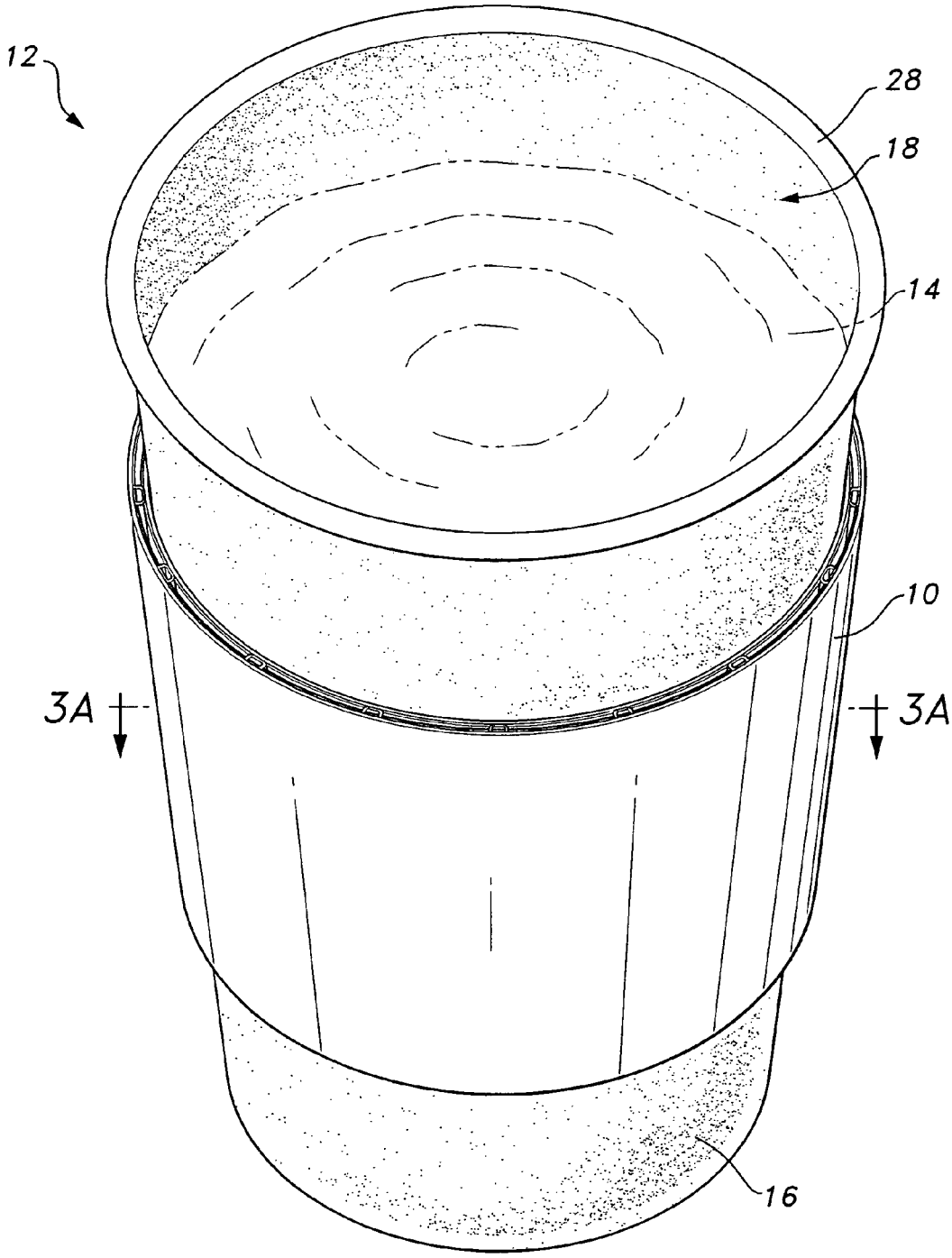
FIG. 1 is an environmental, perspective view of a hot beverage cup sleeve according to the present invention attached to a hot beverage cup.

FIG. 1 generally illustrates a hot beverage cup sleeve 10 mounted on a beverage cup 12 containing hot fluid or beverage 14, such as coffee, tea or other types of hot beverage. The beverage cup 12 holds beverages, whether hot or cold, and has a tapered tubular wall 16 with an open top 18 and a rim 28 for holding a lid.

Heat from the beverage 14 may escape out the open top 18 and may be transferred through the tapered tubular wall 16 to the hot beverage sleeve 10. The sleeve 10 prevents or reduces heat transfer by conduction and radiation, thus providing better protection for the person's hand as well as keeping the beverage hot for a longer time period.

Figure 2A:
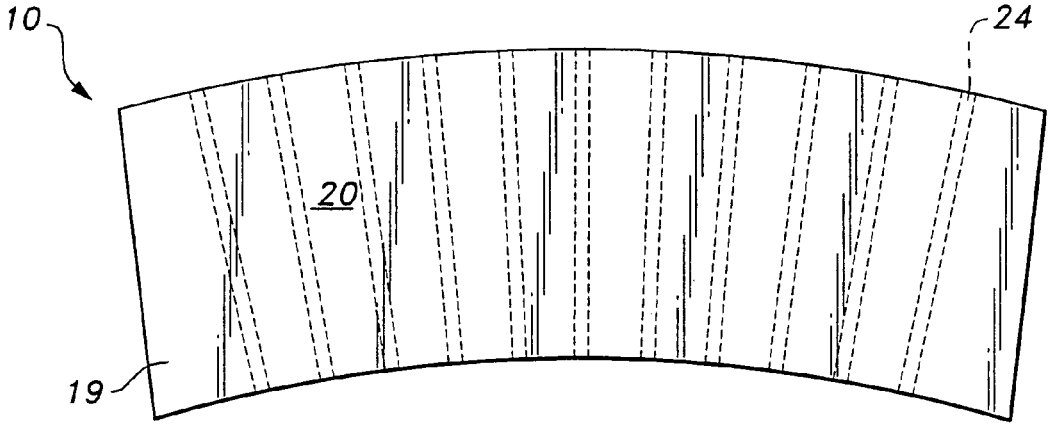
FIG. 2A is a partial front view of an outer surface of a hot beverage cup sleeve according to the present invention.

As shown in FIG. 2A, the sleeve 10 comprises an annular wall 19 coaxial with the cup wall 16 that tapers in diameter from top to bottom to conform to the cup wall 16 and has an outer surface 20 that is smooth and provides an aesthetically appealing exterior that facilitates printing of advertising logos, slogans, or other indicia.

Figure 2B:
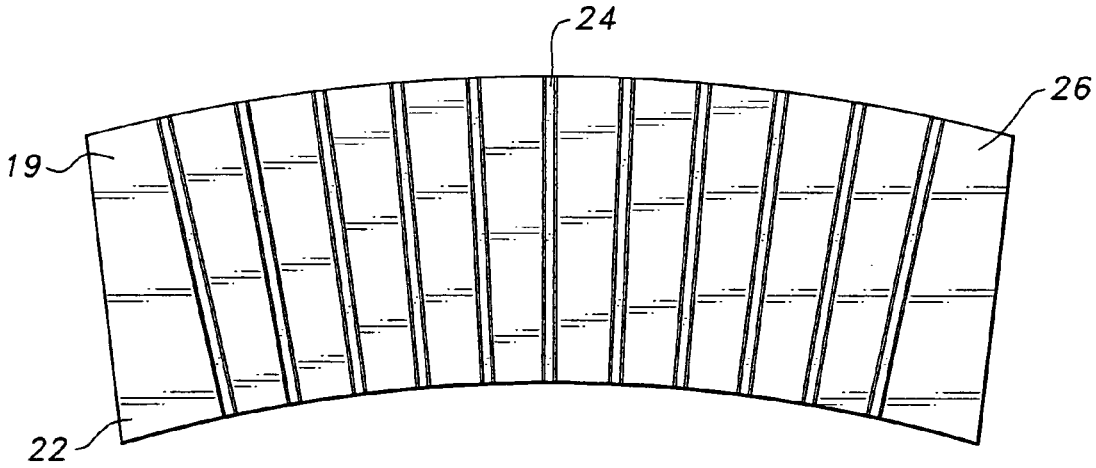
FIG. 2B is a partial front view of an inner surface of the hot beverage cup sleeve according to the present invention.

As shown in FIG. 2B, the inner surface 22 of the wall 19 has insulating strips 24 disposed thereon. In this embodiment, the insulating strips 24 are vertically aligned and equally spaced. The insulating strips 24 are made of a material having low heat conduction coefficient, such as styrofoam or thick paper. Thus, the insulating strips 24 are poor heat conductors and insulate the sleeve 10 from the cup wall 16.

The inner surface 22 of the wall 19 is also covered with a thermal reflective surface 26, such as aluminum foil or painted shiny material, in the gaps between the insulating strips 24. Also, sputtering has been contemplated. The high reflective surface 26 on the inner surface 22 of the wall 19 causes a radiation shield effect in such a way that the inner surface 22 has high thermal reflectivity characteristics. The reflective surfaces 26 cause any heat radiated from the cup wall 16 to be reflected back towards the cup wall 16, thereby keeping the outer surface 20 of the sleeve 10 cool and the beverage 14 warm.

Figure 3A:
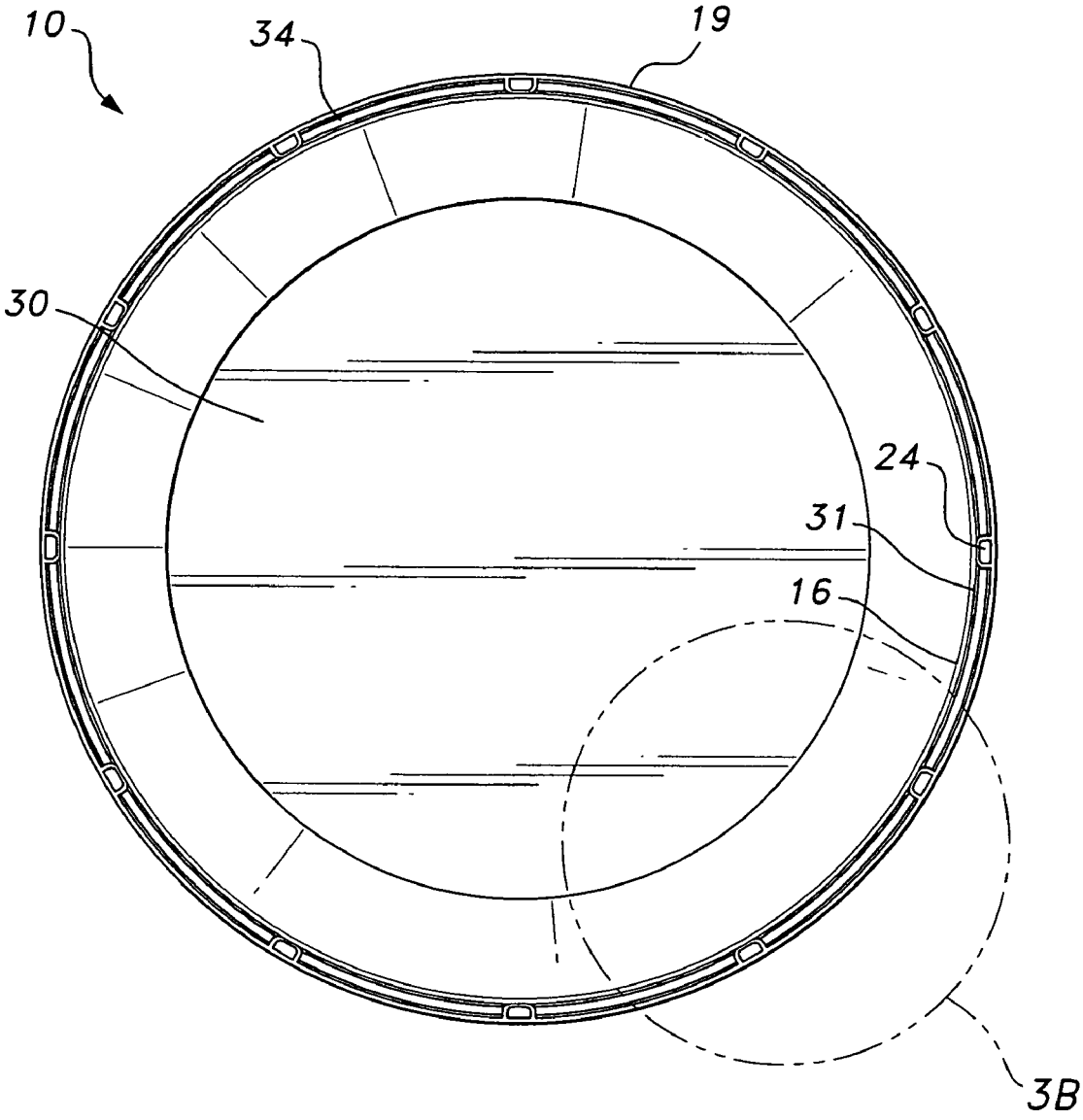
FIG. 3A is a section view taken along lines 3A-3A of FIG. 1.

Referring to FIG. 3A, the sleeve 10 has insulating strips 24 equally spaced between sleeve wall 19 and cup wall 16, defining air gaps 34. The bottom 30 of the beverage cup 12 can be seen in this drawing, as well as the inner part of the tubular cup wall 16. The outer surface of cup wall 16 has been coated with low emissivity film 31 between the insulating strips 24. The insulating strips 24 may be adhered to the outer surface of cup wall 16 to retain the sleeve 10 on the cup 12, or the insulating strips 24 may form a pressure or friction fit against cup wall 16. The insulating strips 24 may be hollow or tubular strips protruding from sleeve wall 19, containing additional insulating air. Alternatively, the strips 24 could contain cardboard or other insulating material, or may be solid strips, depending upon the material used.

Figure 3B:
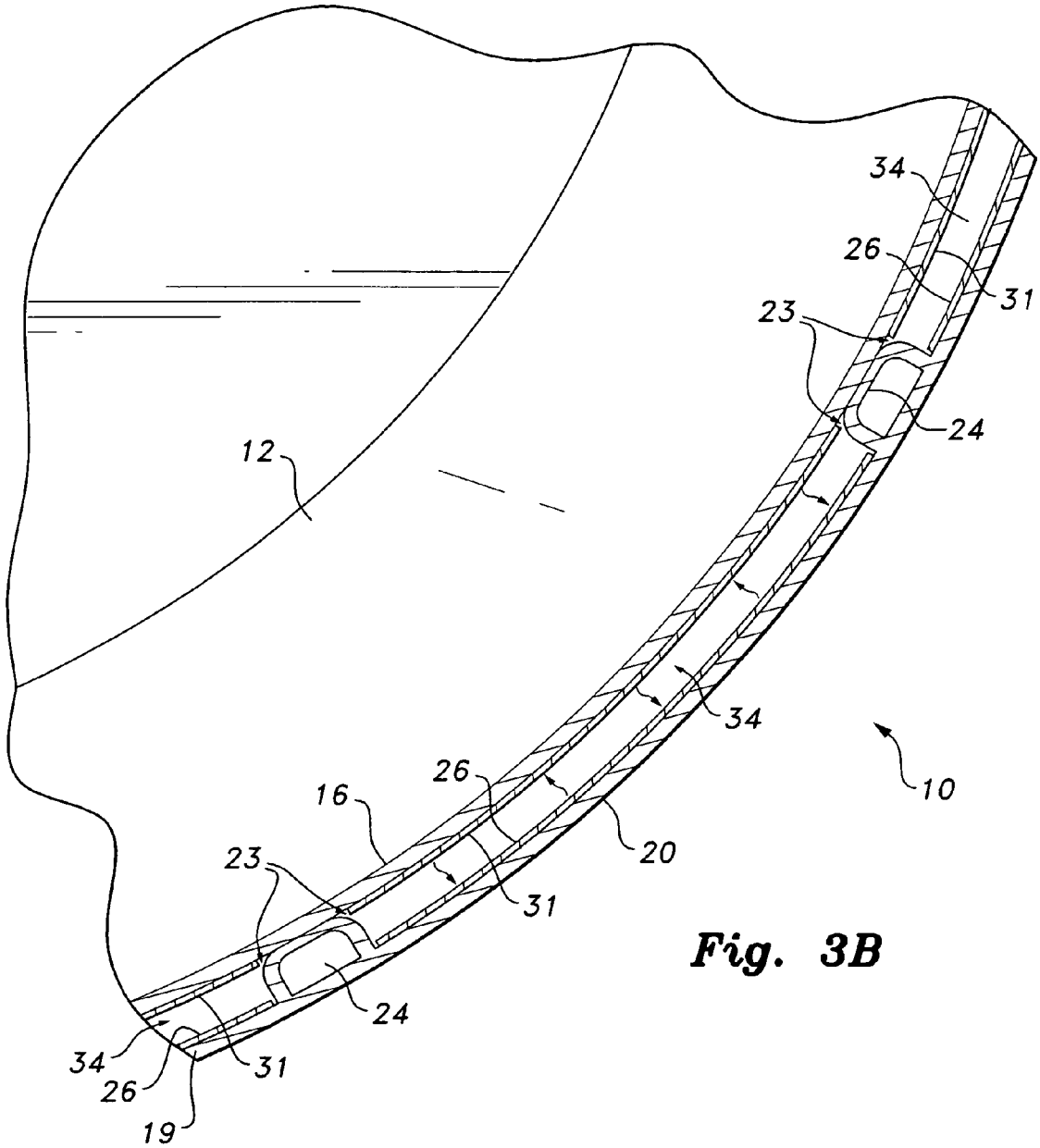
FIG. 3B is an enlarged detail view of area 3B of FIG. 3A.

FIG. 3B is an enlarged detail view showing components of the hot beverage cup sleeve 10 according to a first embodiment of the present invention. In this embodiment, the sleeve 10 and the cup wall 16 have been made to reduce the thermal contact as much as possible. The high reflectivity surfaces 26 on the inner surface 22 of sleeve wall 19 do not touch the insulating strips 24, through which heat is transferred by conduction. Also, the insulating strips 24 do not come into contact with the low emissivity film 31 on the cup wall 16 due to insulating gaps 23. The low emissivity film 31 is placed on the cup wall 16 with gaps or spaces 18 being formed so that the insulating strips 24 do not touch the low thermal emission film 31 on the cup wall 16. This minimizes thermal contact and reduces heat transfer.

Formed between the low emissivity film 31 on the cup wall 16 and the high reflectivity surfaces 26 on the inner face 22 of the sleeve are a plurality of equally spaced air gaps 34. The air gaps 34 assist the insulating strips 24 with insulation as the hot fluid or beverage heats up the tubular cup wall 16.

Figure 3C:
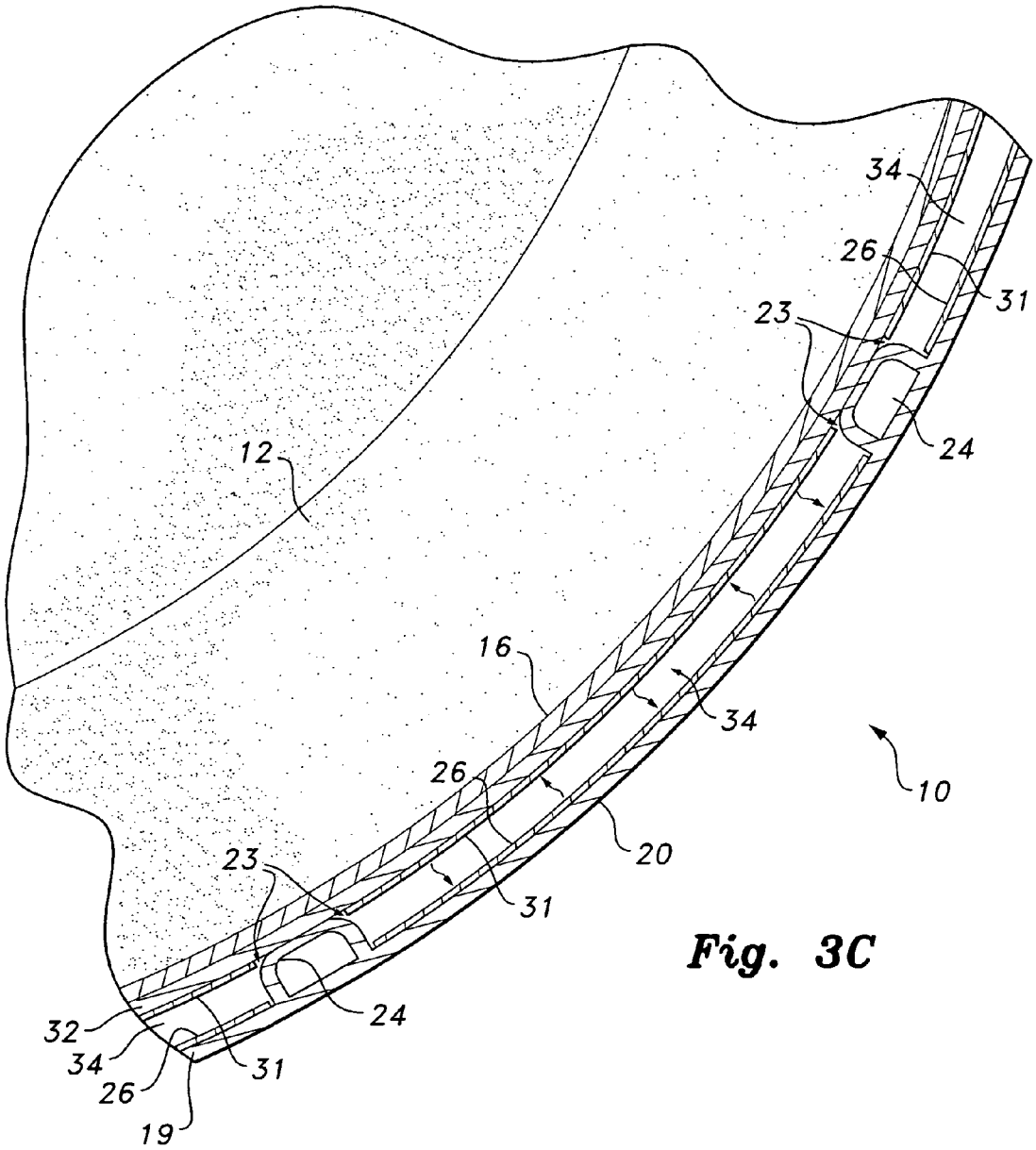
FIG. 3C is an enlarged detailed view of an alternative embodiment of a hot beverage cup sleeve according to the present invention.

FIG. 3C is an enlarged detail view similar to FIG. 3B, but showing components of a hot beverage cup sleeve 10 according to a second embodiment of the present invention. As in the embodiment of FIG. 3B, the sleeve 10 has an annular wall 19 with spaced apart insulating strips 24 and reflective surfaces 26 disposed on the inner surface of sleeve wall 19. However, in this embodiment, the insulating strips 24 are not attached directly to cup wall 16. In this embodiment, the sleeve 10 also has a second, inner annular wall 32 coaxial with cup wall that tapers from top to bottom to conform to cup wall 16. The low emissivity film 31 is coated on the outer surface of inner sleeve wall 32. Insulating strips 24 may be adhered or otherwise attached to the outer surface of sleeve inner wall 32 in gaps formed in the low emissivity film 31 so that the insulating strips 24 do not contact the low emissivity film 31. The sleeve inner wall 32 may be attached to cup wall 16 by adhesive, by pressure or friction fit, or other means. The embodiment of FIG. 3C may be used when it is not feasible or practical to attach the low emissivity film coating 31 directly to the outer surface of cup wall 16.

Figure 4A:
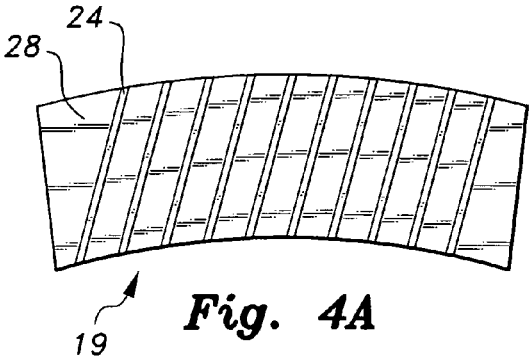
FIG. 4A is a partial front view of the inner surface of another alternative embodiment of a hot beverage cup sleeve according to the present invention, showing inclined insulating strips.
Figure 4B:
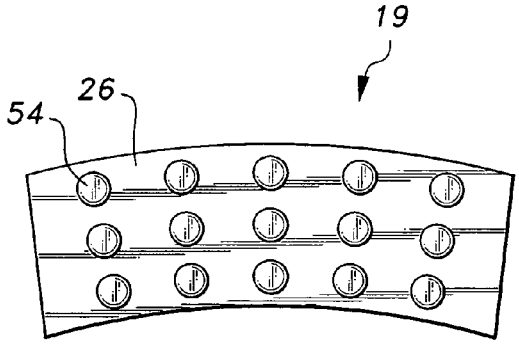
FIG. 4B is a partial front view of the inner surface of another alternative embodiment of a hot beverage cup sleeve according to the present invention, showing circular insulating pads.
Figure 4C:
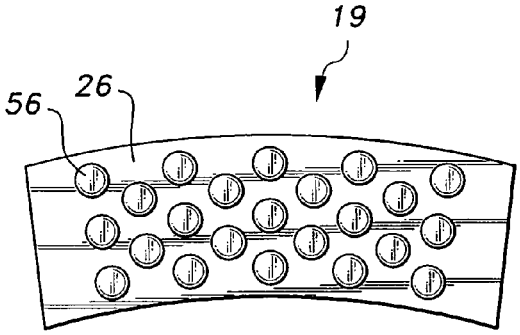
FIG. 4C is a partial front view of the inner surface of another alternative embodiment of a hot beverage cup sleeve according to the present invention, showing staggered insulating pads.
Figure 4D:
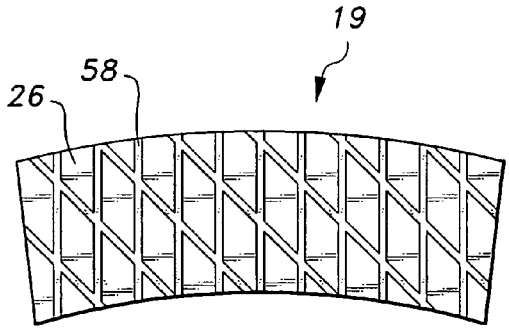
FIG. 4D is a partial front view of the inner surface of another alternative embodiment of a hot beverage cup sleeve according to the present invention, showing a waffle pattern of insulating strips.

FIGS. 4A, 4B, 4C, and 4D show alternative patterns of attaching the insulating strips 24 or pads to the inner surface 22 of sleeve wall 19. In FIG. 4A, the strips 24 are in an inclined or slanted pattern. In FIG. 4B, instead of strips 24, circular insulating pads 54 project from the inner surface of sleeve wall 19 in rows and columns. FIG. 4C shows an embodiment having circular insulating pads 56 in a staggered pattern instead of regularly aligned columns and rows. Finally, FIG. 4D illustrates the insulating strips 58 in a waffle or diamond-shaped pattern. The insulation projecting from sleeve wall 19 may have any desired pattern, providing the insulation spaces sleeve wall 19 from the cup wall 16, does not touch the low emissivity film 31 or thermal reflective surface 26, and has sufficient thermal resistance to retard the conduction of heat from the cup wall 16 to the sleeve wall 19.

It is to be understood that the present invention is not limited to the embodiments described above, but encompasses any and all embodiments within the scope of the following claims.

We claim:

1. A hot beverage cup sleeve adapted for attachment to a hot beverage cup, the sleeve comprising:

an outer annular wall having an inner surface and an outer surface, the outer annular wall being adapted for coaxial attachment around a wall of the beverage cup;

a plurality of insulating bodies projecting from the inner surface of the outer annular wall, the insulating bodies being spaced apart, defining gaps therebetween, the insulating bodies being adapted for spacing the sleeve outer annular wall away from the cup wall and defining air gaps therebetween; and a plurality of thermally reflective surfaces attached to the inner surface of the outer annular wall in the gaps between the insulating bodies for radiating heat away from the outer annular wall back towards the cup, wherein each said thermally reflective surface is spaced apart from a corresponding pair of said insulating bodies such that a pair of insulating gaps is formed between each said thermally reflective surface and the corresponding pair of said insulating bodies.

2. The hot beverage cup sleeve according to claim 1, further comprising a low heat emissivity film adapted for coating onto the cup wall in gaps between points of contact between the insulating bodies and the cup wall.

3. The hot beverage cup sleeve according to claim 1, wherein said insulating bodies comprise elongated strips of thermal insulation material.

4. The hot beverage cup sleeve according to claim 3, wherein said strips are tubular.

5. The hot beverage cup sleeve according to claim 3, wherein said strips are aligned vertically from top to bottom.

6. The hot beverage cup sleeve according to claim 3, wherein said strips are aligned in a diamond-shaped pattern.

7. The hot beverage cup sleeve according to claim 1, wherein said insulating bodies comprise circular pads.

8. The hot beverage cup sleeve according to claim 7, wherein said pads are aligned in columns and rows.

9. The hot beverage cup sleeve according to claim 8, wherein said rows are staggered.

10. A hot beverage cup, comprising:

a cup adapted for receiving a hot beverage, the cup having a cup wall;

an annular sleeve wall having an inner surface and an outer surface, the annular sleeve wall being coaxially disposed around the cup wall;

a plurality of insulating bodies projecting from the inner surface of the sleeve wall, the insulating bodies being spaced apart, defining gaps therebetween, the insulating bodies spacing the sleeve wall away from the cup wall and defining air gaps therebetween;

a plurality of thermally reflective surfaces attached to the inner surface of the sleeve wall in the gaps between the insulating bodies for radiating heat away from the sleeve wall back towards the cup wall, wherein each said thermally reflective surface is spaced apart from a corresponding pair of said insulating bodies such that a pair of insulating gaps is formed between each said thermally reflective surface and the corresponding pair of said insulating bodies; and a plurality of low heat emissivity film surfaces coated onto the cup wall in gaps between points of contact between the insulating bodies and the cup wall, wherein each said low heat emissivity film surface is spaced apart from a corresponding pair of said insulating bodies such that a pair of insulating gaps is formed between each said low heat emissivity film surface and the corresponding pair of said insulating bodies.

11. The hot beverage cup according to claim 10, wherein said insulating bodies comprise elongated strips of thermal insulation material.

12. The hot beverage cup sleeve according to claim 11, wherein said strips are tubular.

13. The hot beverage cup sleeve according to claim 12, wherein said strips are aligned vertically from top to bottom.

14. The hot beverage cup sleeve according to claim 10, wherein said insulating bodies comprise circular pads.

15. The hot beverage cup sleeve according to claim 1, wherein said insulating bodies are configured for direct attachment to the cup wall.

16. The hot beverage cup sleeve according to claim 1, further comprising an inner annular wall coaxial with the outer annular wall, the inner annular wall having a inner surface adapted for engagement with the cup wall and an outer surface.

17. The hot beverage cup sleeve according to claim 16, further comprising a low heat emissivity film adapted for coating onto the outer surface of the inner annular wall.

18. The hot beverage cup sleeve according to claim 16, wherein said insulating bodies are configured for direct attachment to outer surface of the inner annular wall.

* * * * *